United States Patent [19]

Sholl et al.

[11] Patent Number: 4,846,357

[45] Date of Patent: Jul. 11, 1989

[54] OFFSHORE STATION ARTICULATED BOOM MAINTENANCE UNIT

[75] Inventors: Arthur F. Sholl, Omaha, Nebr.; Bruce R. Flint, Logan, Iowa; Donald L. Wolfe, Wahoo, Nebr.

[73] Assignee: Paxton-Mitchell Company, Omaha, Nebr.

[21] Appl. No.: 241,587

[22] Filed: Sep. 8, 1988

Related U.S. Application Data

[63] Continuation of Ser. No. 62,264, Jun. 15, 1987, abandoned.

[51] Int. Cl.[4] ..... B66F 11/04

[52] U.S. Cl. ..... 212/190; 182/2; 212/187; 212/188

[58] Field of Search ..... 212/187, 188, 190, 192; 114/268, 222; 182/2; 405/196, 208; 37/73

[56] References Cited

U.S. PATENT DOCUMENTS

| | | | |
|---|---|---|---|
| 1,581,849 | 4/1926 | Madsen | 114/222 |
| 3,179,370 | 4/1965 | Bailey | 37/73 |
| 3,357,517 | 12/1967 | Wagner | 182/2 |
| 3,637,043 | 1/1972 | Zwight et al. | 182/2 |
| 3,741,143 | 6/1973 | McKinley et al. | 212/192 |
| 3,807,575 | 4/1974 | Merrick | 182/2 |
| 3,834,488 | 9/1974 | Grove | 182/2 |
| 3,841,436 | 10/1974 | Grove | 182/2 |
| 3,963,095 | 6/1976 | Hedges | 182/2 |
| 4,070,978 | 1/1978 | Virgilio | 37/73 |
| 4,254,730 | 3/1981 | Crenshaw | 405/208 |
| 4,326,601 | 4/1982 | Grove et al. | 182/2 |
| 4,456,093 | 6/1984 | Finley et al. | 182/2 |
| 4,461,369 | 7/1984 | Amador | 182/2 |
| 4,646,875 | 3/1987 | Sholl | 182/2 |
| 4,667,771 | 5/1987 | Tranchero | 182/2 |
| 4,679,653 | 7/1987 | Pasquarette et al. | 182/2 |

FOREIGN PATENT DOCUMENTS

| | | | |
|---|---|---|---|
| 846399 | 8/1960 | United Kingdom | 182/2 |
| 1294011 | 10/1972 | United Kingdom | 114/222 |

*Primary Examiner*—Sherman D. Basinger
*Assistant Examiner*—Thomas J. Brahan
*Attorney, Agent, or Firm*—Henderson & Sturm

[57] ABSTRACT

This invention relates to an articulated boom structure unit (15) adapted to be mounted on an ocean going lift barge (16) for maintenance of an offshore station (14), and having a platform (17) vertically movable relative to ocean floor engageable leg units (18); the boom structure (15) comprising a pedestal (23) mounted for rotation on the platform (17), with a first boom unit (26) pivotally mounted on the pedestal for vertical, pivoting movement, a mounting (29) supported on the outer end of the first boom unit (26) and held on a vertical axis, a second telescoping boom unit (32) connected at an inner end on said mounting (29) for movement in a horizontal plane, a third platform boom unit (33) mounted at an inner end to the outer end of the second boom unit (32) and having a parallelogram subassembly (34) as a part thereof movable upwardly and downwardly, and a personnel carrier (21) mounted on an outer end of the subassembly (34), which carrier (21) may be either a bucket or a work platform, with the carrier (21) held in a level position by the subassembly (34) and tiltable to a vertical position relative to the third boom unit (33). In one modified form thereof, the personnel carrier (21) is arcuately moveable in both a horizontal plane and a vertical plane relative to the second boom unit (32).

3 Claims, 5 Drawing Sheets

OFFSHORE STATION ARTICULATED BOOM MAINTENANCE UNIT

This is a continuation of application Ser. No. 062,264 filed on June 15, 1987 now abandoned.

TECHNICAL FIELD

The structure of this invention relates generally to an articulated boom structure mounted on a lift barge for use in maintaining the superstructure of an offshore work station, such as an offshore oil rig. The boom structure is mounted on the platform of the lift barge such that with the concomitant raising and lowering of the platform and the articulated, telescoping movement of the boom structure, a personnel carrier at the outer end thereof can be positioned at necessary locations below the deck of the work station. The lift barge and boom structure are hydraulically operated by controls by conventional means.

BACKGROUND ART

Due to the harsh environment offshore oil platforms are exposed to, it becomes necessary to sandblast and paint the structure at least once every three years. In order to gain access to the underside or superstructure, it has been necessary to build scaffolding and the like so that workmen might reach the areas which require maintenance. This approach has proved unsatisfactory. Another approach involved the placement of a conventional articulated-type crane on the deck of the station; however, this arrangement was also unsatisfactory due to the use of a large area of deck space necessary, which deck space is at a premium.

The use of lift boats, or jackup barges for use in connection with transporting equipment to and from offshore work stations or platforms is well known as is the use of conventional, articulated boom structures for placing personnel carriers such as a bucket or work platform, about and below bridges and the like for maintenance purposes. Such boom structures are operated either by hydraulic means, or by reel and cable means.

The general hydraulic electric and control equipment and functions of this type of boom structure equipment are well known in this art. Three examples of articulated and extensible boom structures are shown in U.S. Pat. Nos. 3,262,517 to Malec; 3,498,474 to Pierce, Jr.; and 4,646,875 to Sholl.

DISCLOSURE OF THE INVENTION

The invention comprises a unit for placing personnel about and under the deck of an offshore work station for maintenance purposes, which unit comprises: a floating lift barge including a platform and leg means mounted thereon for engaging the ocean floor, means for raising the platform relative to the ocean surface; an articulated boom structure comprising a pedestal mounted for rotation about a normally vertical axis on the platform; a first boom unit pivotally mounted on the pedestal for vertical, pivoting movement; a mounting supported on the outer end of the first boom unit and held on a vertical axis; a second boom unit connected at one end to the mounting for movement in a horizontal plane; a third boom unit connected at one end to the second boom unit and including a subassembly tiltably movable in a vertical plane; and a personnel carrier connected to the third boom unit subassembly and maintainable in a horizontal plane for the safety of personnel carried thereby, the personnel carrier movable by the third boom unit relative to the second boom unit thereby.

The unit of this invention comprises further a personnel carrier which can be pivoted in an arc about an end of a telescoping boom while simultaneously being raised or lowered and rotated in place.

It is an object of this invention to provide a new and novel unit for providing maintenance capabilities to the superstructure of an offshore station without requiring space on the deck of the station and without requiring scaffolding or other like structure under the deck.

It is another object of this invention to provide an offshore work station maintenance unit utilizing a pedestal mounted on a lift barge with articulated, extensible boom sections rotatably and liftably mounted thereon for supporting a personnel carrier, the personnel carrier swingable on a telescoping boom about a 360° arc and tiltable upwardly or downwardly 70°, respectively.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
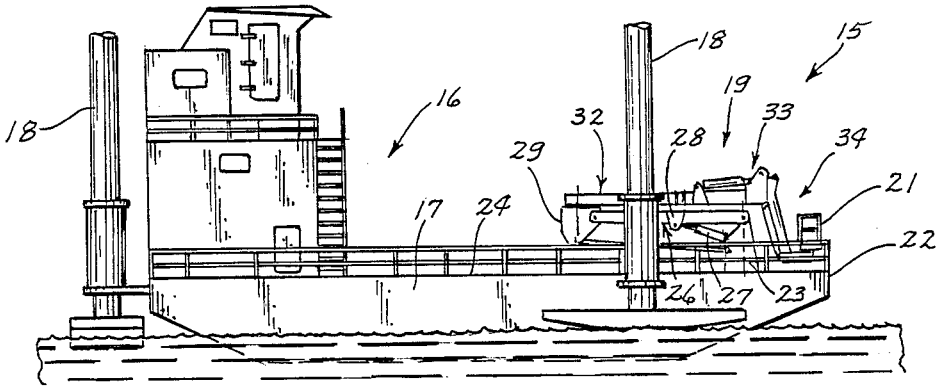
FIG. 1 is a side elevational view of the floating offshore station articulated boom maintenance unit of this invention.
Figure 2:
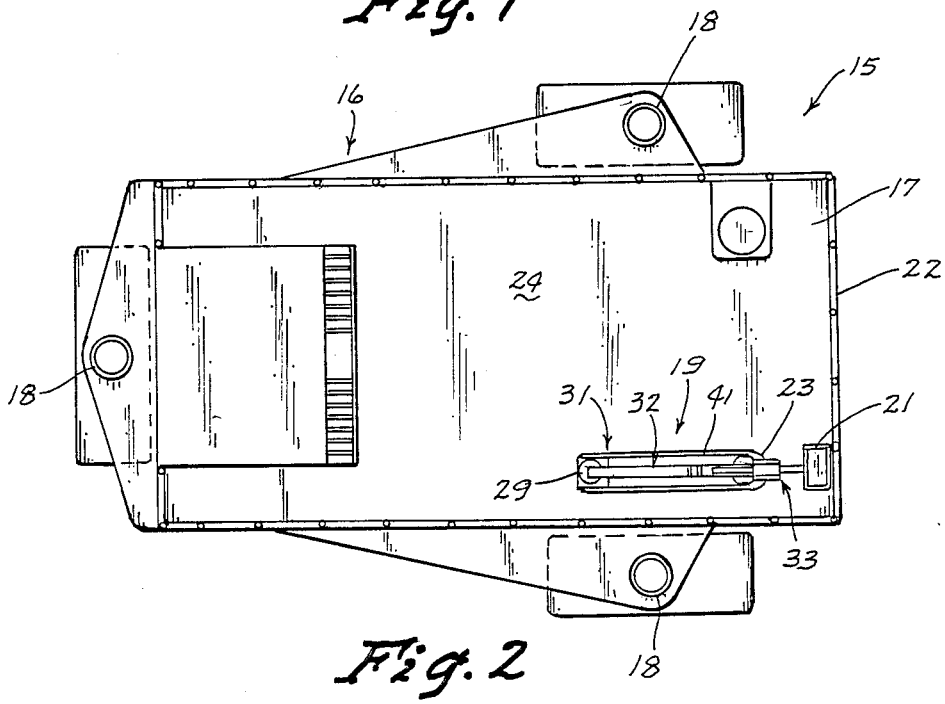
FIG. 2 is a top plan view thereof.

Referring now to the drawings, particularly FIGS. 1 through 7, the offshore station articulated boom maintenance unit of this invention is indicated generally at (15), and comprises basically a floating lift barge (16) including a platform (17) movably mounted on leg units (18), which leg units (18) are hydraulically, vertically movable to engage the ocean floor (not shown), whereby the platform (17) can then be raised to an adjustable height on the leg units (18). The type of lift barge (16) per se, is well known in that art.

The unit (15) comprises further an articulated boom structure indicated generally at (19) and shown (FIG. 2) mounted on one corner of the barge platform (17) with a personnel carrier (21) disposed closely adjacent the bow (22) of the barge (16). As seen hereinafter, operation of the unit (15) is capable of placing the personnel carrier (21) at substantially any position about the superstructure (12) and leg piles (13) of a conventional offshore work station (14) for maintenance purposes. The articulated boom structure (19) comprises generally a conventional pedestal (23) secured to the deck (24) of the barge platform (17), a first power boom unit (26) pivotally mounted at an inner end to the pedestal (23) and fully rotatable about the pedestal (23).

A hydraulically operated piston and cylinder unit (27) extends from a pivotal connection of the pedestal (23) to a connection (28) (FIG. 1) on the first boom (26) such that the articulately mounted first boom (26) can be raised and lowered. The boom structure (19) comprises further a mounting (29) (FIGS. 1 and 3) supported on the outer end of the first boom unit (26) and held on a vertical axis by a parallel bar arrangement (31) pivotally mounted between the pedestal (23) and the mounting (29); a second boom unit (32) connected at an inner end to the mounting (29) for movement in a horizontal plane; a third boom unit (33) connected at an inner end to the outer end of the second boom unit (32) and having a subassembly (34) thereof for raising and lowering the personnel carrier (21); and the personnel carrier (21) completing the maintenance unit (15).

More particularly, the mounting (29) connection between the first and second boom units (26), (32), respectively, includes a plate (36) (FIG. 5) with pivotal connections (37), (38) for the outer end (39) of the first boom (26) and the outer end (41) of the parallel bar (31), respectively. This arrangement maintains the mounting (29) on a vertical axis regardless of the position of the first boom unit (26). A hydraulic motor (42) and a gear box (43) therefor are mounted on the inner end (47) of the second boom (32) to drive, via a pinion (44), which pinion (44) walks about a large ring gear (46) mounted on the upper level of the plate (36), whereby the second telescoping boom unit (32) is rotatable 360° (non-continuous) in a horizontal plane. The unit (32) includes a stationary boom (47) (FIGS. 3 and 4), and a pair of telescoping booms (48), (49), the latter provided with boots (51), as are all hydraulic cylinders and telescoping booms.

Figure 3:
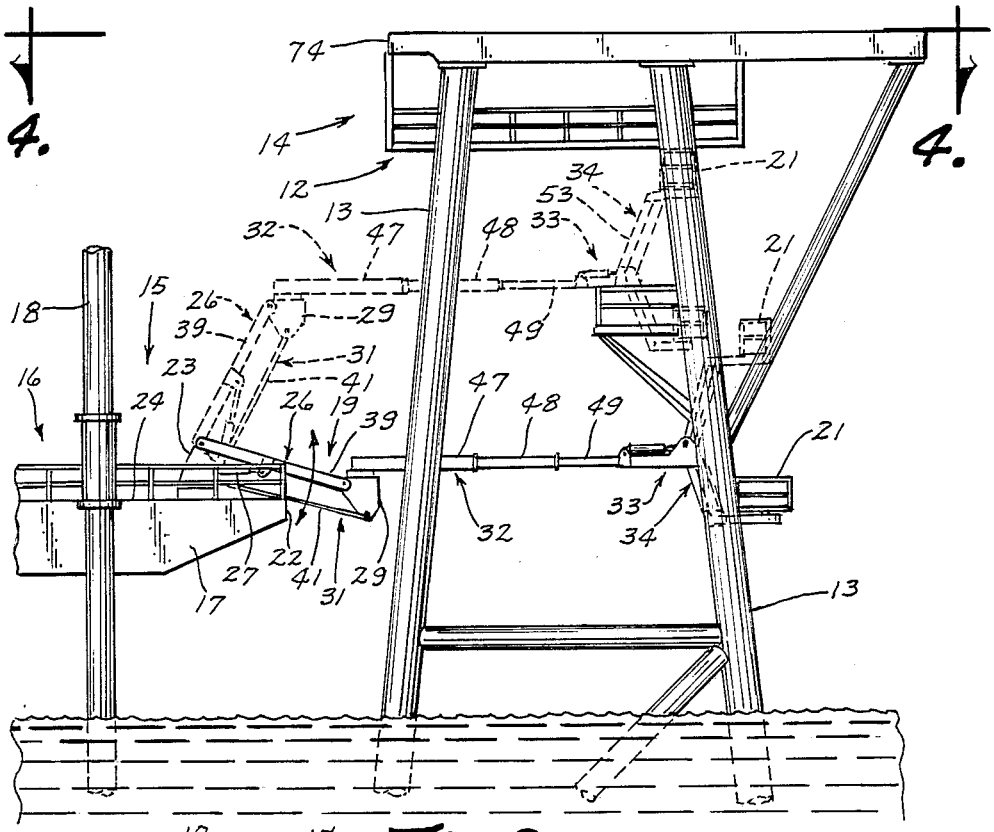
FIG. 3 is a side elevational view of a portion of the maintenance unit adjacent an offshore work station, the unit having legs supported on the ocean floor with the platform thereof raised, and with the boom structure in an extended position, with dotted lines showing changed positions thereof.

The third boom unit (33) comprises a link (52) (FIG. 6), the parallelogram subassembly (34) FIG. 3 and a piston and cylinder unit (54) (FIG. 6) interconnected therebetween for tiltably raising and lowering the assembly (53). The link (52) has a pivotal connection (56) at one end for the cylinder unit (54) and a first plate (57) mounted at the outer end thereof, with an outer ear (58) and an upper ear (60). To the outer ear (58) is pivotally connected at (59) the outer ear portion (61) of a second plate (62), whereas to the upper ear (60) of the plate (57) the inner ear of the rod (66) is pivotally connected by means of a pivot member (65).

Figure 6:
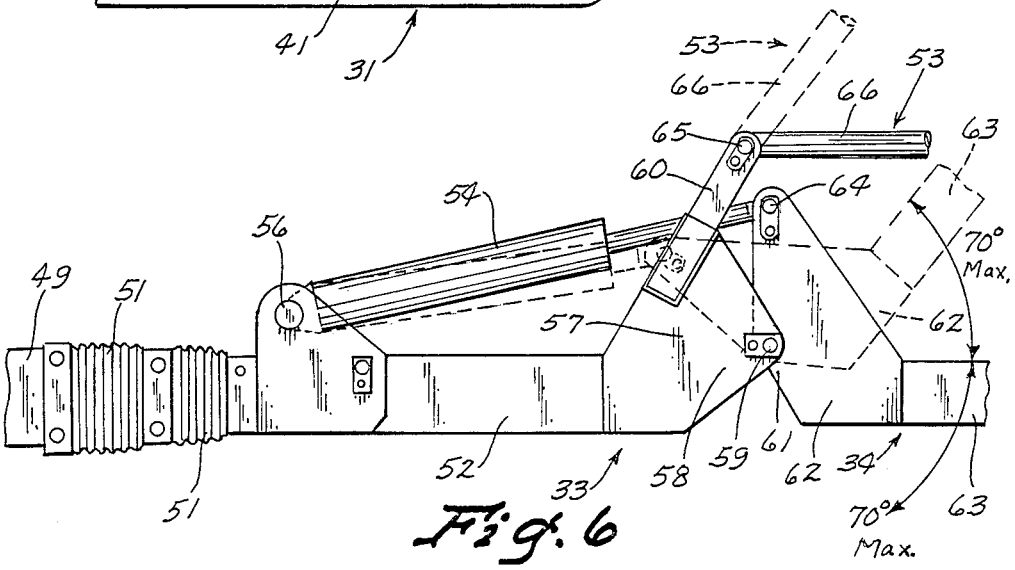
FIG. 6 is a detail, elevational view of the structure of the outer end of the second telescoping boom unit and to which a parallelogram subassembly is mounted for lifting and lowering the personnel carrier.
Figure 7:
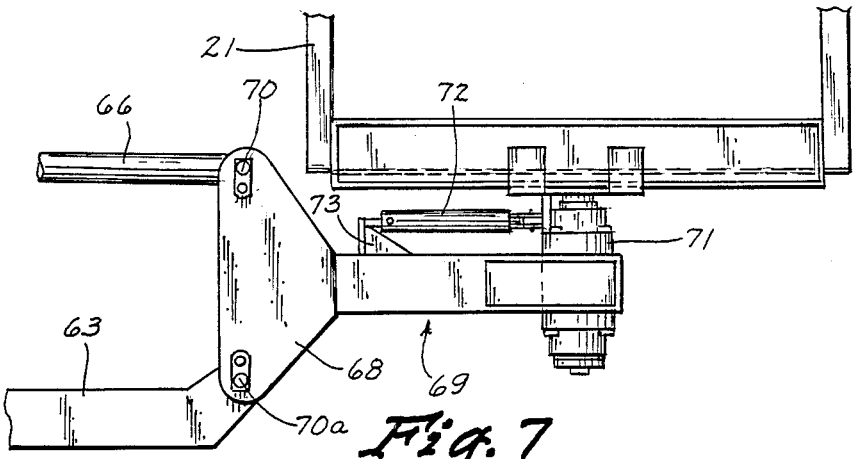
FIG. 7 is a detail, elevational view of the mounting arrangement for the personnel carrier at the outer end of the subassembly.
Figure 8:
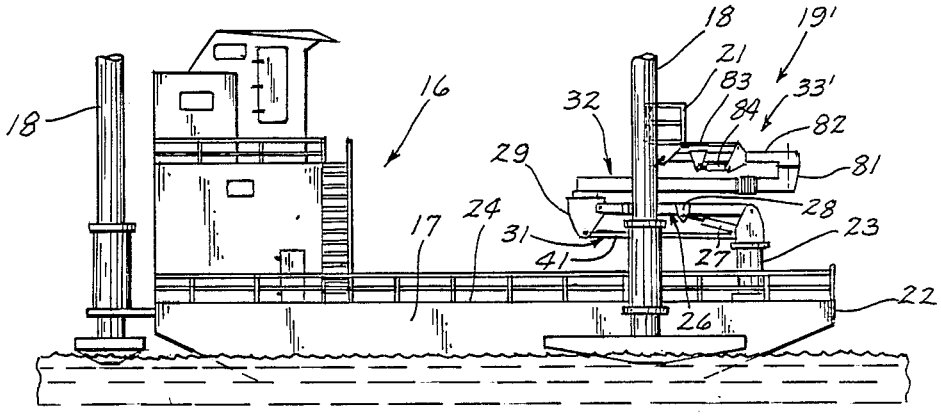
FIG. 8 is a modified version of the floating offshore station articulated boom maintenance unit of FIG. 1.
Figure 9:
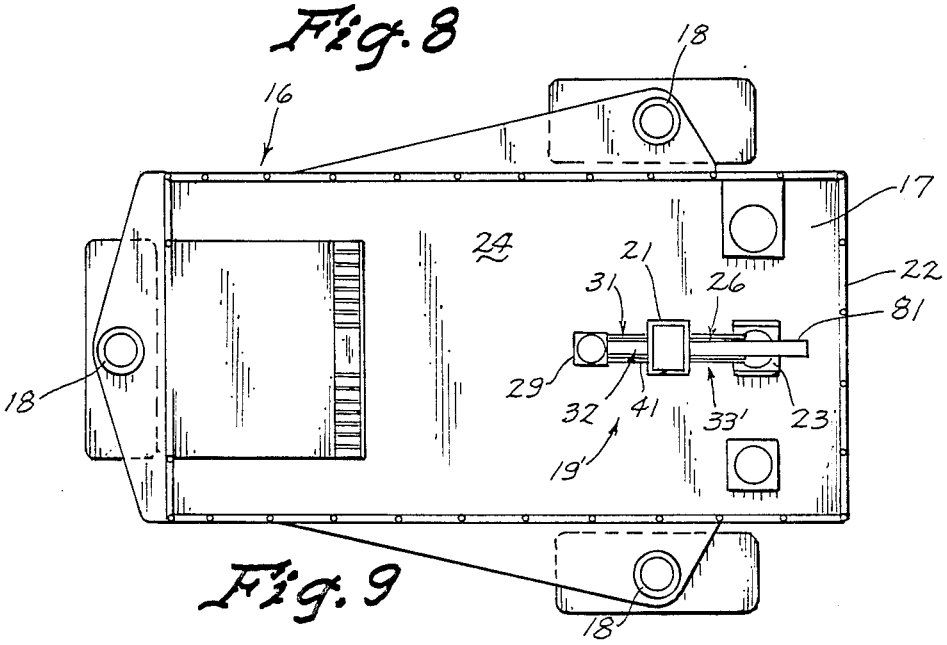
FIG. 9 is a plan view of the structure of FIG. 8.

The plate (62), integral with the inner end of an arm (63) of the subassembly (34) is pivotally connected at (64) with the outer end of the cylinder unit (54). By this arrangement, the parallelogram subassembly (34) of the third boom unit (33) is tiltable upwardly and downwardly at a 70° angle as best illustrated in FIG. 6, the tilting action due to pivoting of the plate (62) and parallelogram subassembly (34) about the pivot (59), due to action of the cylinder (54).

At the upper outer ends of the rod (66) and arm (63) (FIG. 7), the inner end plate (68) of a personnel carrier support unit (69) is pivotally connected thereto at a pair of pivots (70, 70*a*), the parallelogram subassembly (53) arranged for maintaining the support unit (69) in a normally horizontal disposition. The carrier (21) (FIG. 7) is rotatably mounted by means of a rotary unit (71) at the outer end of the support unit (69), which rotary unit (71) is rotatable in either direction 90 by means of a piston and cylinder unit (72) interconnected between the unit (71) and a bracket (73) on the support unit (69).

Referring to FIG. 1, it is to be noted that for transportation purposes, the articulated boom structure (19) is stowable with the first boom unit (26) disposed outward over the barge platform (17), the second boom unit (32) disposed directly over and parallel to the first boom unit (26), and the third boom unit (33) extended toward the bow of the barge (16) in axial alignment with the second boom unit (32). To decrease the overall length of the boom structure (19) on the barge (16), the subassembly (34) of the third boom unit (33) can be depressed, thereby also depressing the personnel carrier (21).

Figure 4:
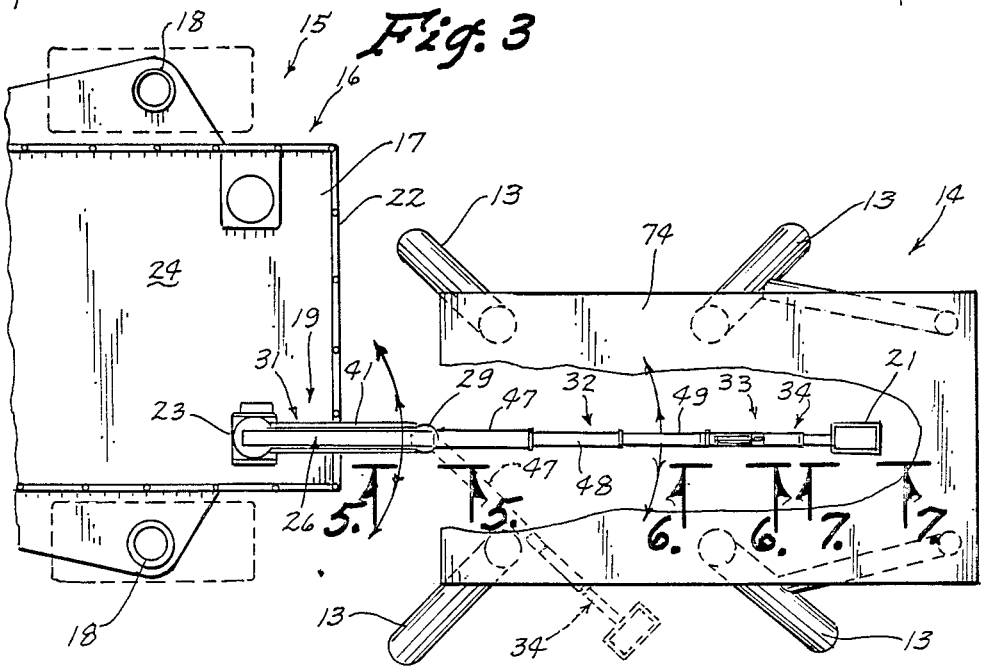
FIG. 4 is a plan view of the structure of FIG. 3, with certain parts broken away for clarity of illustration.
Figure 5:
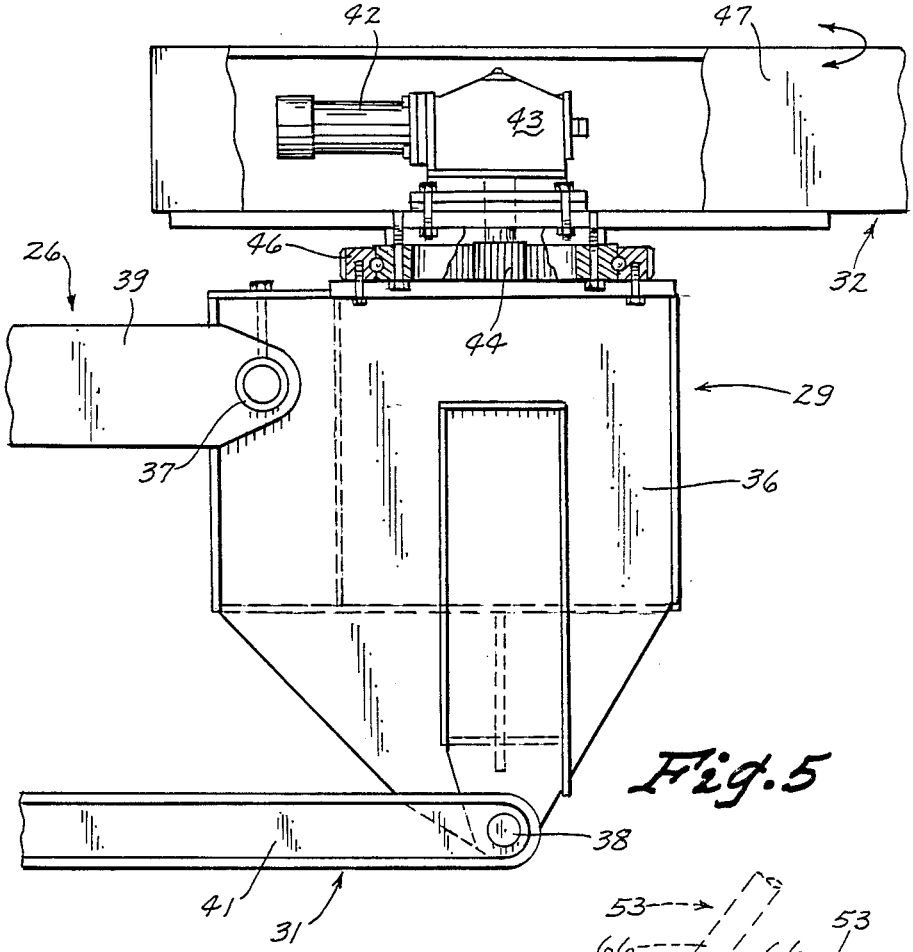
FIG. 5 is an enlarged detail elevational view of the mounting supported on the outer end of the first boom unit and to which the inner end of the second telescoping boom unit is rotatably mounted.

Referring to FIGS. 3 and 4, it is clearly seen that while the first boom unit (26) is being raised or lowered in a vertical plane, such that the mounting (29) is movable from a position above or below the surface or deck (24) of the barge platform (17), the second and third boom units (32), (33), respectively, are simultaneously movable in horizontal planes; and further wherein the personnel carrier (21) whether bucket or platform is tiltable upwardly or downwardly thereby extending the reach of the carrier (21) to all portions of the superstructure (12) and leg piles (13) supporting the deck (74) of an offshore work station. The first boom unit (26) has a 360° non-continuous rotation about the pedestal (23), and the second and third boom units (32), (33) also have a 360° non-continuous rotation about the mounting (29).

Referring to FIGS. 8 through 11, a modified version (19') of the articulated boom structure (19) of FIGS. 1 through 7 is illustrated. The change is clearly shown in FIG. 10, the pedestal (23), first power boom unit (26), mounting (29) and second boom unit (32) being identical as those of the FIGS. 1 through 7 embodiment, but at the outer end of the second boom unit (32), a second mounting (81) substantially identical to mounting (29) is disposed, rotatably supporting a modified third boom unit (33').

Figure 10:
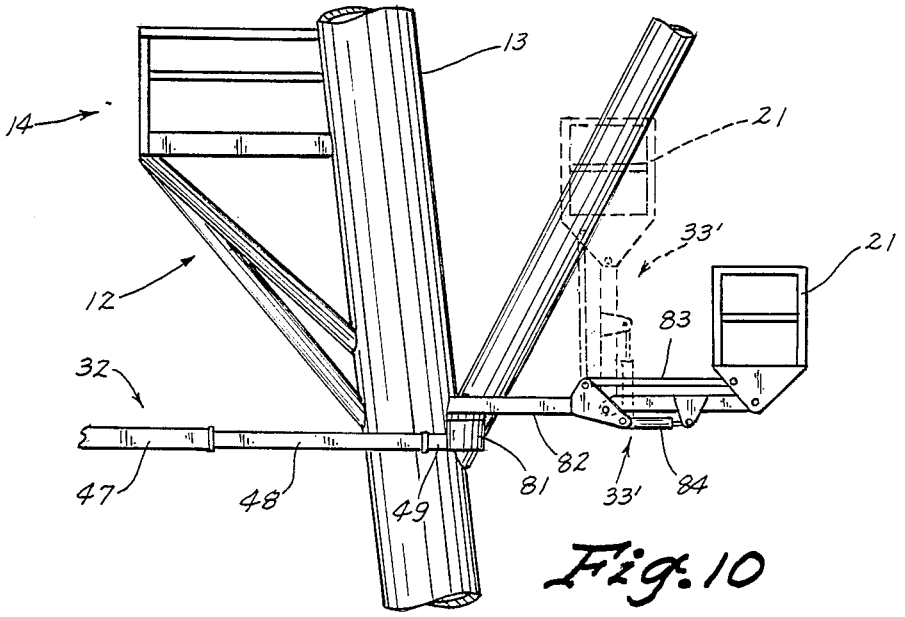
FIG. 10 is an enlarged detail elevational view of the modified third boom unit arrangement of the FIG. 8 structure.
Figure 11:
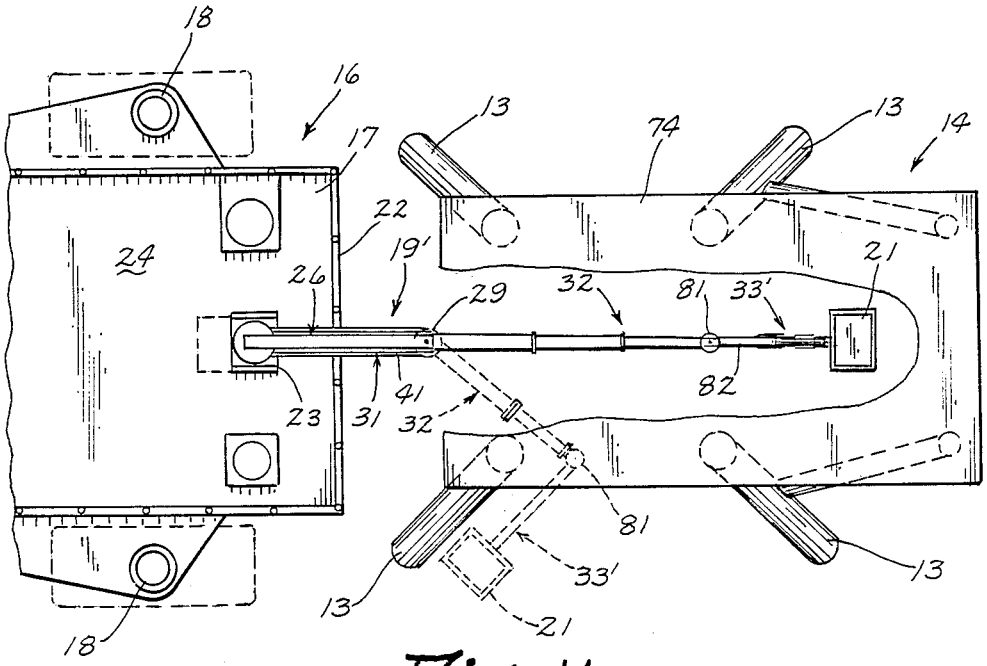
FIG. 11 is a plan view of the structure of FIG. 10, with dotted lines used for alternate positions.

The modified third boom unit (33') comprises a swingable arm (82) (FIG. 10) having a conventional parallelogram subassembly (83) connected thereto, with an activating hydraulic piston and cylinder (84) as a part thereof interconnected between a plate (85) at the outer end of the arm (82) and a bracket (86) secured to an arm (87) part of the subassembly (83). The rod of the subassembly (83) and the arm (87) are both pivotally connected to the base (8) of the personnel carrier (21). Thus, as best shown in FIGS. 10 and 11, not only can the first and second boom units (26), (32), respectively, be vertically and horizontally moved simultaneously, but also the third boom unit (33) can be pivoted about the mounting (81) in a horizontal plane such as to extend about sharp corners for alternate accessibility of the offshore platform superstructure for maintenance purposes.

To place the modified version (19') in transport position on the barge platform (17), the arrangement is similar to that of embodiment (19); however, the third boom unit (33') is swing aft about the second mounting (81) and is disposed with the carrier (21) directly over and parallel to the second boom unit (32).

At least two sets of conventional controls (not shown) are recommended: one set mounted on the pedestal (23), and a second set at the personnel carrier (21). As the hydraulic and electric power and control systems and units are conventional and do not form a part of this invention, they are not described in detail herein. Electrical energy is derived from the electrical system of the barge, a 240 volt generator (not shown) providing power for a piston compensated hydraulic pump (not shown) capable of generating up to approximately 2300 psi for the hydraulic needs of the boom structure (19) or (19'). In addition to conventional hydraulic lines valves and controls therefor, not shown, conventional sand blasting and painting supplying lines (not shown) are provided between the barge (16) and boom structure personnel carrier (21) for maintenance purposes relative to the offshore station (14).

This application is being filed with a companion application by the same inventor and a common assignee involving comparable structures, entitled "Offshore Station Inverted Articulated Boom Maintenance Unit".

We claim:

1. A unit for placing personnel about and under an offshore platform for maintenance purposes, comprising in combination:

a floating lift barge including a platform and leg means mounted thereon for engaging the ocean floor, means for raising said platform relative to the ocean surface;

an articulated boom structure comprising:

a pedestal mounted for rotation about a normally vertical axis on said platform;

a first boom unit pivotally mounted on said pedestal for vertical, pivoting movement;

a mounting supported on the outer end of said first boom unit and held on a vertical axis;

a second boom unit connected at one end of said mounting for movement in a horizontal plane;

a third boom unit connected at one end to said second boom unit and including a parallelogram subassembly tiltably movable in a vertical plane;

a personnel carrier connected to said third boom unit subassembly and maintainable in a horizontal plane for safety of personnel carried thereby, said personnel carrier movable by said third boom unit relative to said second boom unit and further wherein said third boom unit comprises a link unit and said parallelogram subassembly, said link unit having a link with a first plate at one end, said first plate having a pair of ears, said subassembly having an arm extended parallel a rod, with a second plate secured to one end of said arm and pivotally connected to said first plate at one of said ears, said rod connected at one end to said second ear of said first plate, and a cylinder pivotally interconnected between an opposite end of said link and said second plate intermediate said first plate ear connection.

2. The unit of claim 1 wherein a support unit is connected to the other, opposite ends of said rod and said arm, which support unit is maintained in a constant horizontal plane, said carrier rotatably mounted on said support unit, and means connected between said support unit and said carrier for rotating said carrier about a vertical axis.

3. An articulated boom structure comprising:

a pedestal mountable for rotation about a normally vertical axis;

a first boom unit pivotally mounted on said pedestal for vertical, pivoting movement;

a mounting supported on the outer end of said first boom unit and held on a vertical axis;

a second boom unit connected at one end to said mounting for movement in a horizontal plane;

a third boom unit having a swingable arm connected at one end to said second boom unit for movement in a normally horizontal plane and including further a subassembly connected to said swingable arm and tiltably movable in a normally vertical plane; and a personnel carrier connected to said third boom unit subassembly and maintainable in a horizontal plane for the safety of personnel carried thereby, said personnel carrier movable by said third boom unit relative to said second boom unit.

* * * * *